United States Patent [19]

Pässler et al.

[11] 4,352,846

[45] Oct. 5, 1982

[54] CLEANING CLOTH

[75] Inventors: Michael Pässler, Neusäss; Bohuslav Tecl, Weinheim; Rolf Schumacher, Hirschberg, all of Fed. Rep. of Germany

[73] Assignee: Carl Freudenberg, Firma, Weinheim an der Bergstrasse, Fed. Rep. of Germany

[21] Appl. No.: 228,488

[22] Filed: Jan. 26, 1981

[30] Foreign Application Priority Data

Feb. 18, 1980 [DE] Fed. Rep. of Germany ... 8004287[U]

[51] Int. Cl.[3] ..... A47L 13/16; B32B 25/02

[52] U.S. Cl. ..... 428/105; 15/209 R; 51/402; 428/195; 428/309.9

[58] Field of Search ..... 428/105, 195, 309.9; 15/208, 209 R; 51/402

[56] References Cited

U.S. PATENT DOCUMENTS 3,112,219 11/1963 Politzer et al. ..... 427/244

4,137,356 1/1979 Shoemaker et al. ..... 428/178 X 4,142,334 3/1979 Kirsch et al. ..... 51/402 X 4,232,128 11/1980 Michel et al. ..... 428/283 X

OTHER PUBLICATIONS

German Application 76-19792.

*Primary Examiner*—Henry F. Epstein

*Attorney, Agent, or Firm*—Sprung, Horn, Kramer & Woods

[57] ABSTRACT

A cleaning cloth for household and industrial use comprising a soft resilient needled nonwoven fabric having a plurality of rubber strips surmounting its top surface in the manner of relief, the height of the rubber strips being about 0.2 to 0.4 times their width but not more than about 0.5 times the thickness of the nonwoven fabric, the nonwoven fabric on its underside carrying a continuous layer of an open-pore latex foam which projects above the bottom surface and penetrates into the nonwoven to the extent of about 10 to 40 percent of the thickness of the nonwoven fabric.

7 Claims, 2 Drawing Figures

CLEANING CLOTH

BACKGROUND OF THE INVENTION

The invention relates to a cleaning cloth for household and industrial use which consists of a soft, resilient needled nonwoven fabric having an imprint of rubber strips surmounting its top surface in the manner of relief.

A cleaning cloth of this type is described in German design patent 76 19 792. There, however, both sides are provided with an imprint of relieflike structure, which means that the cleaning cloth has only limited uses.

SUMMARY OF THE INVENTION

The object of the invention is to improve a cleaning cloth of that type in such a way that it lends itself to broader uses.

In accordance with the invention, this object is accomplished by giving the top and underside of the cleaning cloth different coatings. The latter are characterized in that the height of the rubber strips is about 0.2 to 0.4 times their width but not more than about 0.5 times the thickness of the needled nonwoven fabric, and that the underside is provided with a continuous layer of an open-pore latex foam which extends above the bottom surface and penetrates into the nonwoven to the extent of about 10 to 40 percent of the thickness of the nonwoven. Advantageously the height of the strips ranges from about 0.2 to 1.5 mm, the thickness of the needled nonwoven from about 0.5 to 5 mm and the total thickness of the latex foam backing from about 0.1 to 1 mm.

In use, the surface of the cleaning cloth provided with the rubber strips serves to remove coarser dirt through the scraperlike action of the rubber strips. This scraperlike action is enhanced by the fact that the rubber strips cannot tip over as the cleaning cloth is being used since the latter is stabilized by the continuous layer of open-pore latex foam. Yet the cleaning cloth possesses pronounced resilience, and it is possible, for example, to press the rubber strips without much effort into the structure of the punched nonwoven so as to be flush with its top surface, with the fibers of the nonwoven then bearing directly on the surface of the object being cleaned. This effect is manifest especially when the needled nonwoven contains a small proportion of synthetic fibers in addition to a major proportion of natural fibers, such as cotton, or rayon staple, since the needled nonwoven then possesses not only marked absorbency but also good springback. The proportion of synthetic fibers should be about 5 to 30 weight percent of the fibrous mass, a titer of about from 1.5 to 6 being preferred. Within these limits, it is necessary to use synthetic fibers to coarser titer as the weight percent of synthetic fibers is reduced. The effect will be enhanced if the rubber strips are bounded by a profile with sharply defined edges, for example, a triangular profile.

The rubber strips are preferably made of a relatively firm material, for example, a material having a Shore type A hardness ranging from about 60 to 90. The material may contain closed pores or interconnected pores with a total pore volume of about 10 to 50 percent. When properly designed, the rubber strips will have improved adaptability to differently structured surfaces, in addition to their natural high resilience.

The length of the rubber strips should be about 3 to 8 times their width, the individual rubber strips being preferably offset relative to one another. In this particular arrangement, rubber strips located adjacent to one another may make any desired angle with one another, but preferably an angle ranging from about 20 to 90 degrees.

The rubber strips are preferably imprinted on the face of the cleaning cloth, and this is best done by silkscreen printing using a viscous paste. Chemical crosslinking is preferably accomplished by subsequent heating, which can then also be utilized to crosslink the foamlike latex layer applied to the underside. In accordance with another method which may also be employed, the rubber strips may be punched out of a sheet of uncrosslinked elastomeric material, pressed onto the top surface of the nonwoven fabric, and chemically crosslinked by heating. Crosslinking may also be effected by high-energy irradiation, possibly in a separate operation. In the latter case, the preferred elastomeric materials may be replaced at least in part by thermoplastic materials.

The continuous layer of soft, resilient latex foam is applied to the bottom surface preferably in liquid form, which may be done with the aid of a doctor blade or also of squeeze rolls. The layer is preferably arranged symmetrically relative to the surface of the needled nonvoven so that a portion of the layer penetrates into the interior of the nonwoven, thus producing a highly desirable stiffening effect, while another portion of the foam structure extends below the bottom surface of the nonwoven. The latter portion has particularly soft, resilient properties and is permeated by countless interconnected open pores. These communicate hydraulically with the fibers of the needled nonwoven, thus resulting in a pronounced water-absorption effect which makes the cleaning cloth in accordance with the invention highly suited for a wide variety of household cleaning chores. The cleaning cloth has a very soft, pliant hand and therefore lends itself well to the drying of windows and cars, tiles, wash basins, dishes, etc.

The good practical properties of the cleaning cloth are largely the result of a particularly advantageous combination of the properties of its individual components. Thus the continuous layer of open-pore latex foam provides, in addition to spongelike absorbency, static support for the rubber strips disposed on the face of the cleaning cloth. These may be pressed into the punched nonwoven to be flush with its surface, if necessary. The nonwoven itself serves in the cleaning cloth as a water reservoir whose water-absorptive capacity is affected but slightly by light pressure. Very large amounts of water may therefore be stored in the punched nonwoven without its surface feeling particularly wet. Moreover, when it is desired to remove the stored water, this can readily be done by vigorous wringing.

BRIEF DESCRIPTION OF THE DRAWING

An embodiment of the cleaning cloth in accordance with the invention is shown diagrammatically in the accompanying drawing, wherein.

DETAILED DESCRIPTION OF THE INVENTION

The cleaning cloth consists of a needled nonwoven fabric 3 on whose top surface rubber strips 1 with a triangular profile are disposed in a regularly repeated pattern and whose underside is formed by an open-pore foamed-plastic layer 2. The latter is disposed parallel to the underside of the punched nonwoven, that is to say, it penetrates into the nonwoven to the extent of 50 percent and projects from the nonwoven to the extent of 50 percent.

The composition of the needled nonwoven is as follows:

50% cotton
28% rayon staple dTex 1.7/40 mm
14% polyester dTex 1.7/40 mm
8% polyester dTex 3.3/60 mm The needled nonwoven is formed of crosslaid superposed fiber layers which are linked together through intensive needling at the rate of, say, 45 needles per square centimeter. This intensive needling not only interlaces the individual fiber layers but also results in precise adjustment of the resilience and in a reorientation of large portions of fibers in a direction perpendicular to the surface. The formed-plastic layer disposed on the underside thus communicates with the top surface in a manner enhancing the suction effect. This enhanced suction effect is due on the one hand to the storage capacity of the needled nonwoven, which is largely independent of the external use of pressure, and on the other hand to the fast rate at which the open-pore foamed-plastic layer is able to take up liquid or give it up to the nonwoven. The claimed disposition of the two components relative to each other provides assurance that their respective properties will optimally complement one another.

In addition to the reciprocal interlacing of the fibers resulting from the needling operation, the nonwoven fabric may be strengthened by reciprocal bonding of its fibers at their intersections. However, the nature of the bonding must be such that the resilience is not appreciably impaired. Suited is, for example, impregnation with plastic dispersions based on NBR or SBR latices, polyacrylates or polyurethanes followed by drying and crosslinking by the effect of heat. Also suited is bonding by means of meltable synthetic fibers, or synthetic fibers which become tacky when heated, such as polypropylene, copolyamide or copolyester fibers, which are homogeneously mixed with the aforesaid fiber blend in an amount ranging from about 10 to 35 percent, and which upon dry heating of the needled nonwoven result in the further strengthening thereof.

The rubber strips illustrated have a triangular profile and a height which is small in relation to the width of the base area. This makes for good scraping action and provides assurance against tipping when lateral stresses arise. The top edge of the rubber strips may be rounded and, if so designed, may optionally comprise a groove extending parallel to its axis. Polygonal profiles may also be used. However, casr should be taken in all cases that the height/width ratio is within the range claimed.

Figure 1:
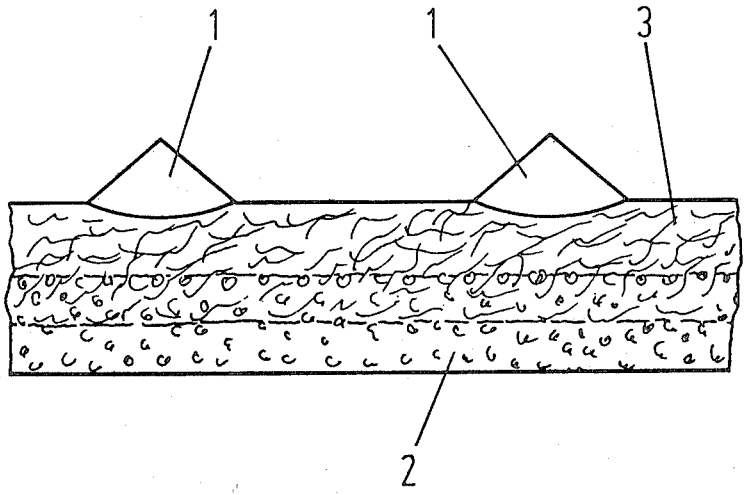
FIG. 1 is a longitudinal section through the cleaning cloth.
Figure 2:
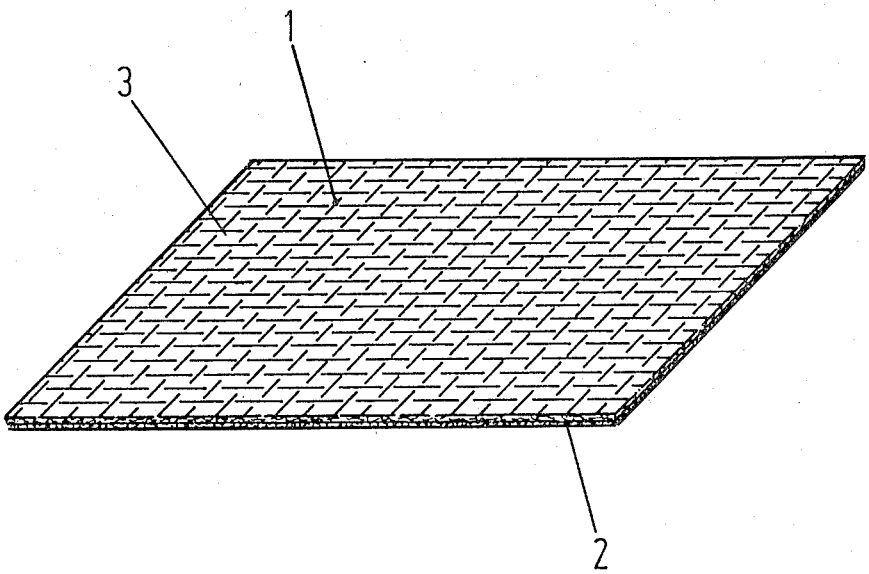
FIG. 2 is a perspective top view of the cleaning cloth.

The rubber strips may be associated with one another in any desired pattern. A preferred embodiment is shown in FIG. 2. However, parallel strips are also possible, as are serpentine or concentric circular strips.

It will be appreciated that the instant specification and claims are set forth by way of illustration and not limitation, and that various changes and modifications may be made without departing from the spirit and scope of the present invention.

What is claimed is:

1. A cleaning cloth for household and industrial use comprising a soft resilient needled nonwoven fabric having a plurality of rubber strips surmounting its top surface in the manner of relief, the height of the rubber strips being about 0.2 to 0.4 times their width but not more than about 0.5 times the thickness of the nonwoven fabric, the nonwoven fabric on its underside carrying a continuous layer of an open-pore latex foam which projects above the bottom surface and penetrates into the nonwoven fabric to the extent of about 10 to 40 percent of the thickness of the nonwoven fabric.

2. A cleaning cloth according to claim 1, wherein the rubber strips have a Shore type A hardness of 60 to 90.

3. A cleaning cloth according to claim 1, wherein the rubber strips contain closed or interconnected pores to a total extent of about 10 to 50 percent of the volume of the rubber strips.

4. A cleaning cloth according to claim 1, wherein the length of the rubber strips is about 3 to 8 times their width.

5. A cleaning cloth according to claim 4, wherein the individual rubber strips are offset relative to one another.

6. A cleaning cloth according to claim 4, wherein the rubber strips are arranged in a regular pattern and the center-to-center distance between adjacent rubber strips is substantially equal to their length.

7. A cleaning cloth according to claim 1, wherein the continuous foam layer extends below the bottom surface of the non-woven fabric a distance approximately equal to that to which it projects into the nonwoven fabric.

* * * * *